US007937803B2

(12) United States Patent
Witter

(10) Patent No.: US 7,937,803 B2
(45) Date of Patent: May 10, 2011

(54) BAG HOLD-DOWN FOR DUST COLLECTION SYSTEM

(76) Inventor: Robert M. Witter, Syracuse, NY (US)

( * ) Notice: Subject to any disclaimer, the term of this patent is extended or adjusted under 35 U.S.C. 154(b) by 1537 days.

(21) Appl. No.: 11/190,167

(22) Filed: Jul. 26, 2005

(65) Prior Publication Data

US 2007/0022564 A1 Feb. 1, 2007

(51) Int. Cl.

| | |
|---|---|
| ***A47L 9/10*** | (2006.01) |
| ***A47L 9/20*** | (2006.01) |
| ***B01D 50/00*** | (2006.01) |
| ***B01D 59/50*** | (2006.01) |

(52) U.S. Cl. ..... 15/347; 55/315

(58) Field of Classification Search ..... 15/347; 55/315, 345

See application file for complete search history.

(56) References Cited

U.S. PATENT DOCUMENTS

| | | | | | |
|---|---|---|---|---|---|
| 3,871,847 | A | * | 3/1975 | Fish | 55/372 |
| 3,973,335 | A | * | 8/1976 | Price | 434/126 |
| 4,182,386 | A | | 1/1980 | Alack | |
| 4,523,936 | A | | 6/1985 | Disanza, Jr. | |
| 4,697,389 | A | * | 10/1987 | Romine | 451/354 |
| 4,735,639 | A | * | 4/1988 | Johnstone | 55/302 |
| 4,811,453 | A | * | 3/1989 | Lubraniecki | 15/347 |
| 4,838,907 | A | | 6/1989 | Perry | |
| 5,018,328 | A | * | 5/1991 | Cur et al. | 52/406.2 |
| 5,092,913 | A | * | 3/1992 | Yen | 95/286 |
| 5,106,488 | A | | 4/1992 | Jonasson | |
| 5,252,408 | A | * | 10/1993 | Bridges et al. | 428/621 |
| 5,547,331 | A | * | 8/1996 | Podd et al. | 414/808 |
| 6,018,843 | A | | 2/2000 | Disanza | |
| 6,035,485 | A | * | 3/2000 | Holsten | 15/326 |
| 6,079,080 | A | * | 6/2000 | Rutter et al. | 15/410 |
| 6,085,383 | A | * | 7/2000 | Wulff et al. | 15/383 |
| 6,115,880 | A | * | 9/2000 | Wulff et al. | 15/351 |
| 6,596,374 | B1 | * | 7/2003 | Adjeleian | 428/131 |
| 6,833,016 | B2 | * | 12/2004 | Witter | 55/337 |
| 7,282,074 | B1 | * | 10/2007 | Witter | 55/300 |
| 7,399,218 | B2 | * | 7/2008 | Witter | 451/353 |
| 7,472,456 | B2 | * | 1/2009 | Moore et al. | 15/323 |

FOREIGN PATENT DOCUMENTS

| | | | | |
|---|---|---|---|---|
| JP | 06190747 | A | * | 7/1994 |
| JP | 07171531 | A | * | 7/1995 |

* cited by examiner

*Primary Examiner* — Joseph J Hail, III
*Assistant Examiner* — Alvin J Grant
(74) *Attorney, Agent, or Firm* — Bernhard P. Molldrem, Jr.

(57) ABSTRACT

A vacuum bag hold-down arrangement for a dust collection system maintains a negative pressure in the space between a dust collection drum and a plastic film liner or bag in the drum. A cyclonic separator at the station separates the dust from an air flow and deposits it into the liner in the drum. The hold-down arrangement employs a vacuum pump producing about 1 to 3 psig negative pressure. A vacuum conduit extends from the pump through a penetration in the drum and into the space between wall of the drum and the liner bag. A porous pad, e.g., open cell foam, is situated over the vacuum conduit and separates the bag liner from the vacuum conduit. This distributes the air flow into the vacuum conduit and creates a more uniform grip of the liner or bag to the drum.

21 Claims, 3 Drawing Sheets

BAG HOLD-DOWN FOR DUST COLLECTION SYSTEM

BACKGROUND OF THE INVENTION

This invention is directed to devices and equipment for collecting bulk solids, for example, process dust coming from a dust generator, such as a sanding machine, wherein the dust is entrained in a flow of air from the source machine, and is separated out at a dust collection station where the dust falls into a drum, barrel, or similar container. The invention is more specifically directed to a compact and efficient system for collecting and storing production dust from a work area and where the dust is conveyed to a collection station located outside the work area.

For many types of machines for processing a workpiece, some means has to be provided to dispense with the grindings, chips, and particulate matter that is generated by a machine during operation. For example, in the case of wood working machines, such as sanders, joiners, and the like, wood that is removed from a workpiece has to be collected and removed from the work area so as to avoid either a breathing hazard for the workman or a fire hazard. More specifically, in the case of portable equipment, such as floor sanders and edgers, it is conventional to draw off the dust that is generated by the machines and then send the air that is carrying the dust into a filter bag arrangement, or to draw off the dust through a flexible hose or conduit. In such case, the conduit or hose extends from a dust outlet duct of the machine to a collection station. A stream of air is pumped through the conduit, with the entrained process dust. An example of a dust collection system of this general type is shown in U.S. Pat. No. 6,833,016, which is incorporated herein by reference.

Where bulk solids are collected directly inside a drum or barrel, it would be desirable to have the bulk solids collected in a plastic bag or liner for easy removal and disposal.

At the dust collection station, the air flow and entrained process dust are drawn through a cyclone separator disposed atop a storage drum or barrel. The process dust falls into a durable plastic film bag or liner in the barrel, and the air then proceeds to a pumping and filtering arrangement, where the dust-free air is discharged back into the ambient environment. In order to keep the inherent vacuum within the cyclonic separator from drawing the plastic liner out of the barrel, it is typical to have a vacuum hose extending to the wall of the barrel to evacuate the space between the wall of the barrel and the liner. Here the intention is to maintain a vacuum or negative pressure as a bag hold-down feature, to draw and hold the bag against the inside of the barrel. Then, when the bag has been filled to its capacity, the bag can be tied off and lifted out, which eliminates the need to dump the barrel. This also avoids exposure to the operators of the process dust when the collected dust is removed from the barrel for disposal.

In practice, the main dust collection system and the collection container run under a negative air pressure or vacuum relative to ambient. As a result of the negative system pressure, a plastic bag or liner tends to be sucked out of the barrel due to the system vacuum, inducing the liner to collapse, at least partially. This results in the bag not filling completely, or in some cases actually being drawn into the separator, and ripped or torn. Dust collection systems that operate at low pressure need an independent source of higher pressure to hold the liner to the drum.

The previously proposed solution to this has simply been to apply vacuum from the system to the space between the barrel and the liner so as to pull the bag against the walls of the barrel. The intention of this is equalize air pressure outside and inside the plastic barrel liner with the hope that the liner would remain securely in place and achieve the maximum fill volume. However, in operation, the vacuum inside the bag or liner can still exceed that between the liner and the barrel, so it would be preferable to employ a higher vacuum to the bag hold-down arrangement. On the other hand, where a vacuum hose from a vacuum pump is simply inserted into the space between the barrel wall and the liner, there is a tendency for the liner to collapse onto the end of the vacuum hose and block the flow of air into the vacuum hose. This would especially be true if the bag hold-down vacuum is of significantly greater magnitude than the dust collection system vacuum. Also, there is a need to deal with air leaks where the vacuum hose penetrates the wall of the barrel as well as to accommodate air leakage around the rim of the barrel.

OBJECTS AND SUMMARY OF THE INVENTION

Accordingly, it is an object of this invention to provide an efficient dust collection system that avoids the drawbacks of the prior art.

It is a more specific object to provide a dust collection system in which a liner or bag at the dust collection station is held securely to the inside of the drum or barrel.

It is a further object of this invention to provide a dust collection system in which the bag or liner hold-down system is efficient and inexpensive, and has a low energy draw.

According to an aspect of the invention, a dust collection system is provided for collecting production dust from a source that generates such dust in a production operation. The dust is conveyed in a flow of air in which the dust is entrained, and then the dust is separated from the air and stored in a collection bag within a dust collection barrel. The bag is favorably formed of a durable plastic film, e.g., 4 mil thickness. The dust collection barrel can be situated at a collection station remote from the dust source. Typically, the source is a device or machine exhausts that the dust entrained into the stream of air to an exhaust outlet on the source machine. A conduit connects to a dust separator at the remote collection station. The separator is mounted above the barrel such that the dust entrained in the flow of air separates out and falls into the bag liner in the barrel. The flow of air continues to a pump and filter arrangement that provides a negative pressure to induce flow of air. At the pump and filter arrangement, the air is cleaned and returned into the ambient as clean filtered air.

According to preferred embodiments of this invention, there is a bag hold-down arrangement for maintaining a negative pressure between the bag and the wall and bottom of the barrel. Where the vacuum system for dust collection is sufficiently strong, this can be used for the bag hold down as well. However, in many cases the system vacuum may not be sufficient, and an additional vacuum source is needed. In these preferred embodiments, a vacuum pump produces a negative pressure of a magnitude greater than the negative pressure of the pump and filter arrangement. In practice, this can be about one to three psi (gauge). A vacuum hose arrangement extends from the vacuum pump through a penetration in the barrel into an interior space of said barrel. A porous pad, which can favorably be a block of an open cell plastic foam, is situated over a distal end of said hose within said barrel. This pad serves to diffuse air flow from the space between the bag and the barrel into the distal end of the hose. The pad maintains separation between the barrel liner and the air inlet on the vacuum hose. This keeps the bag from collapsing and blocking the evacuation of air from the space between barrel and liner. The pad also filters out some of the dust that may be present in the barrel, and protects the vacuum pump.

In a preferred embodiment, the vacuum pump may be a small-volume pump, inducing a negative pressure of about one to three psig, i.e., about 0.10 kg/cm$^2$, and at an air volume of about 10 liters/minute. An in-line air filter is interposed in the vacuum hose between the pump and the penetration through the barrel.

In preferred embodiments, a bulkhead fitting is used at the barrel penetration. A proximal portion of the vacuum hose or tube is sealably fitted to the bulkhead fitting and extends towards the vacuum pump. A distal portion of the vacuum hose is sealably fitted to the bulkhead fitting inside the barrel, and extends into the interior of the barrel, i.e., into the porous foam block or similar porous pad.

In one favorable embodiment the bulkhead fitting includes a threaded tube or open nipple that passes through said barrel penetration. Outer and inner seals are disposed over the threaded tube and are situated against outer and inner sides of the barrel side wall, respectively. Threaded fastener means, e.g., nuts, mounted onto the outer or male thread of the threaded tube hold the outer and inner seals against the side wall of said barrel; and first and second nuts or similar threaded fittings for hold the proximal and distal portions of the vacuum hose to the exterior and interior ends of said threaded tube.

The vacuum hose can be formed of a common flexible tubing of about one centimeter diameter, i.e., about 3/16 to 1/4 inch inside diameter.

While the porous pad can favorably be a member formed of an open-cell plastic foam, it may instead be formed of a block of any suitable open textured material. This may instead be a fibrous open-textured material, rather than a foam. In a preferred embodiment, the block may be about six inches across and about one inch in thickness, and having the distal end of said vacuum hose penetrating into the block. In other possible embodiments, the pad may be round and occupy substantially the entire base of the barrel.

A power switch may be situated for switching on power to the vacuum pump simultaneously with application of power to said pump and filter arrangement. In some cases, the power switch arrangement may have a delay mechanism so as to turn on power to the vacuum pump in advance of application of power to said pump and filter arrangement.

The above and many other objects, features, and advantages of this invention will become apparent from the ensuing detailed description of the preferred embodiments, which is illustrated in the accompanying Drawing.

DETAILED DESCRIPTION OF A PREFERRED EMBODIMENT

Figure 1:
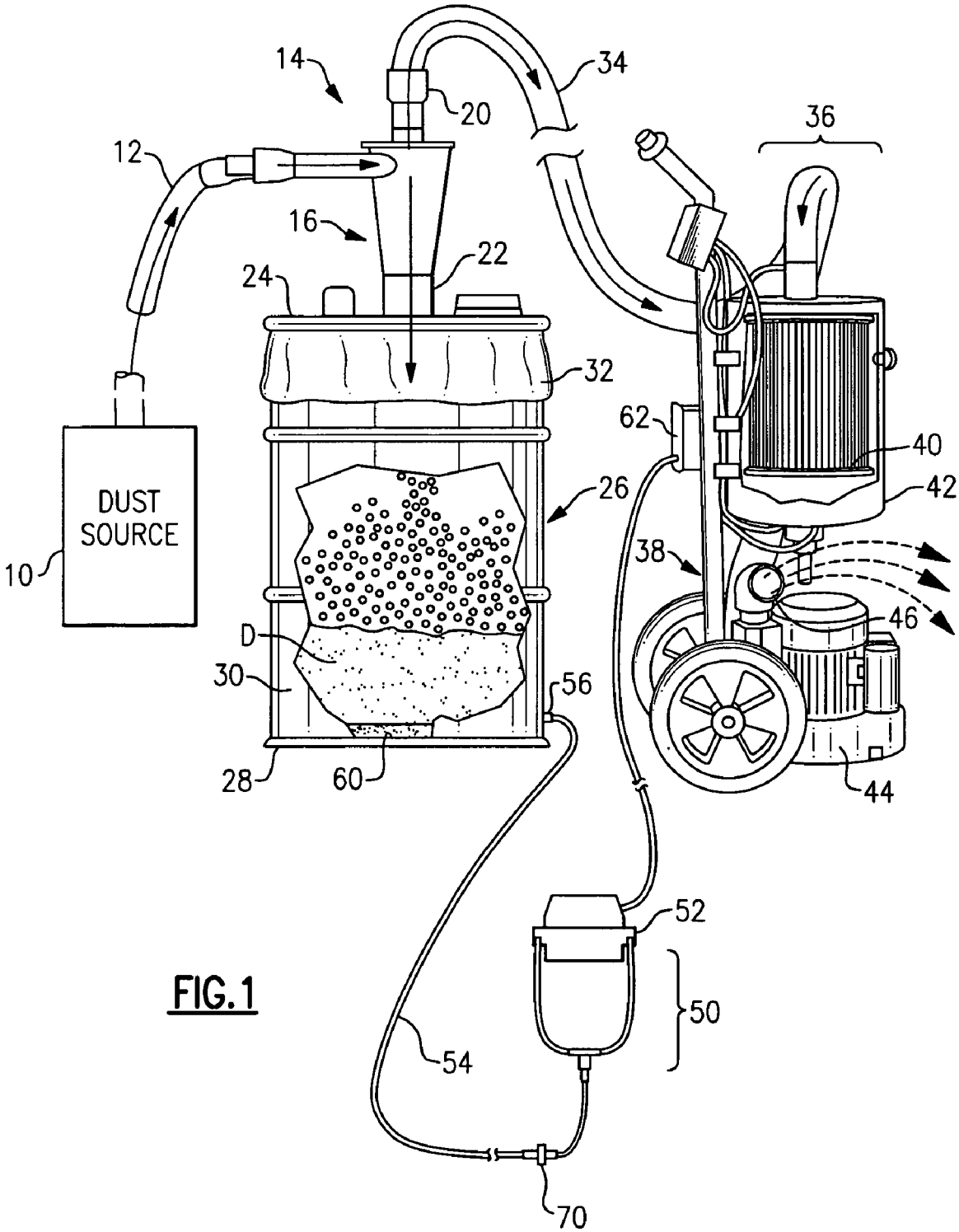
FIG. 1 is a perspective system view of a dust collection station with a bag hold-down system according to one embodiment of this invention.
Figure 2:
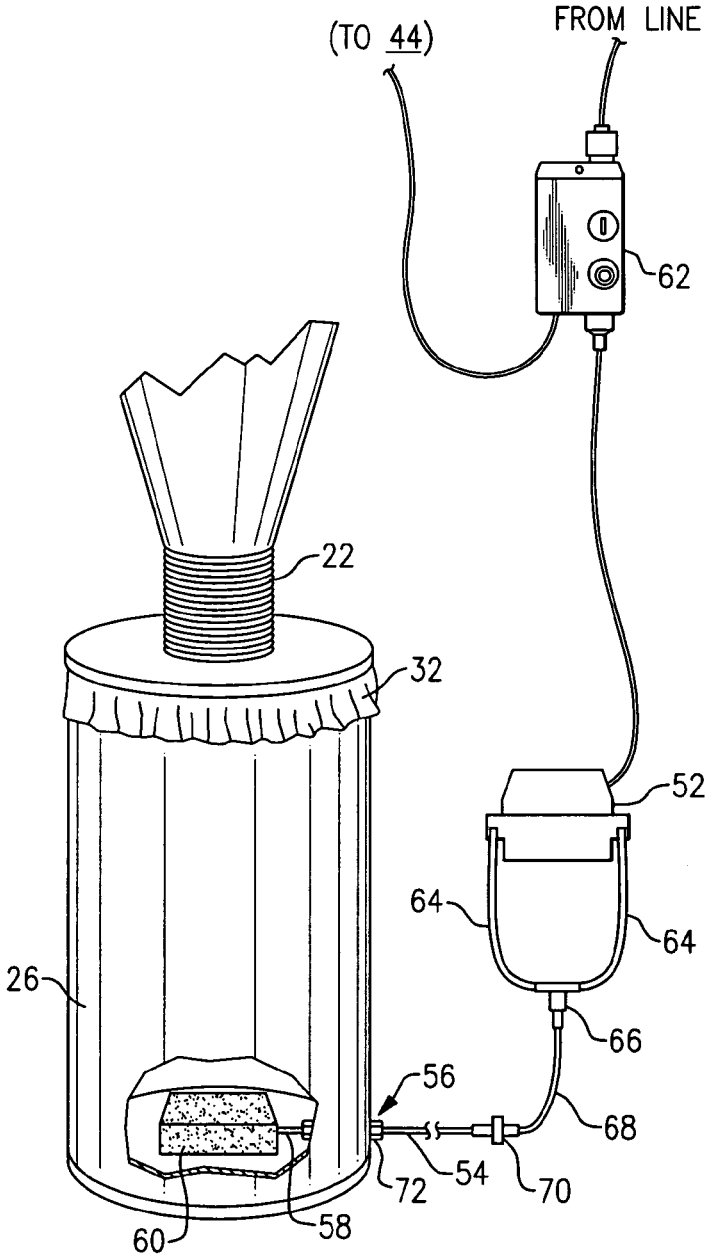
FIG. 2 is a schematic view showing the bag hold-down system.

Now with reference to the Drawing, FIG. 1 shows a dust collection system according to an embodiment of this invention in which dust is separated from the air flow at the tool or machine, with the air being cleaned and returned to the ambient in the vicinity of the tool and with the dust being transported on a smaller volume air flow to a remote collection site. A dust source 10, e.g., generating machine or tool such as a floor sanding machine, may have a built-in exhaust blower that vacuums up any sanding dust produced and discharges it. A flexible conduit 12 extends from the dust source 10 to an inlet connection on a dust collection station 14, which may be located remotely from the dust source. At the dust collection station, a cyclonic separator 16 has an inlet pipe 18 that is connected with the conduit 12, and receives a stream of air and entrained dust. At an upper portion of the separator 16 there is an air exhaust port 20, and beneath the cone-shaped upper part there is a dust conduit 22 that extends downward from a nose of the separator. The cyclonic separator separates the dust out from the air flow and the dust then proceeds downward through a barrel closure plate 24 into a drum or barrel 26. The barrel has a base or bottom 28 and a cylindrical side wall 30 that extends upwards to a mouth or rim on which the plate 24 is supported. Any other suitable container could be substituted, which need not have a circular or cylindrical shape.

A bag or liner 32 which favorably is formed of a polyethylene film of 4 mil thickness is situated in the barrel 26. A closed lower end of the liner 32 rests on the bottom 28 of the barrel, and an open upper end of the liner extends out the top of the barrel and is draped over the rim, under the closure plate 24. In this embodiment process dust D, e.g., wood dust, accumulates in the barrel, and when the barrel is sufficiently full, the liner 32 can be closed off and lifted out of the barrel and replaced with a fresh liner. In this view, the side wall 30 of the barrel is shown partly cut away to illustrate the accumulation of the process dust D. The bag or liner can be tied off and lifted out when full, thus eliminating the need to dump. This also keeps the operators from being exposed to the fines and dust contained in the bag. The independent stand-alone nature of the waste collection drum or barrel also allows for different size barrels to be interchanged easily and cost effectively, accommodating the scope of the project and the volume of waste material to be collected. There may be different size liners to match the different size barrels.

Exhaust air from the separator 16 is carried via a conduit 34 to an air pump and filter unit 36. This unit 36 is preferably mounted on a dolly 38 so that it can be easily wheeled to a convenient place near the work site and later wheeled out when the job is completed. In the air pump and filter unit 36, the exhaust air passes from the exhaust air conduit 34 through a filter 40 within a filter tank 42. An electric air pump 44 draws the air into the outer part of the tank 42 through the filter, and then discharges the air through an exhaust port 46, so that the cleaned, filtered air is returned to the ambient. The pump 44 provides a draw of vacuum that moves the dust, plus a relatively small flow of air, from the dust source 10, through the flexible conduit 12 and into the dust collection station 14, where the air flow continues through the cyclonic separator 16, so that the process dust ends up in liner bag within the barrel 26.

The independent stand-alone dust collection station 14, located downstream of the dust source 10, receives and holds all the processing waste from the portable processing equipment that constitutes the dust source. The dust and air flow moves by means of a small negative pressure operating through the cyclone separator 16, with all the dust being collected in the plastic bag liner 32 inside the drum or barrel 26. As the dust barrel is at a negative pressure, a vacuum bag hold down feature 50 is employed to maintain a vacuum or negative pressure between the barrel and the plastic bag liner to draw and hold the bag to the inside of the barrel.

Details of the vacuum bag hold-down feature 50 are shown in FIG. 1 with additional reference to FIGS. 2, 3, 4, and 5.

In this embodiment, the hold-down feature employs a diaphragm type vacuum pump 52, which draws about ten liters per minute of air volume, and produces about 0.10 $Kg/cm^2$ negative pressure, or about 172 mBar vacuum. The vacuum pump should produce between about one and three pounds per square inch (gauge) negative pressure, which will exceed the vacuum of the system, and will produce a higher vacuum between the liner and the wall of the barrel than the vacuum inside the liner. This ensures that the bag or liner will not be sucked out of the barrel.

Figure 5:
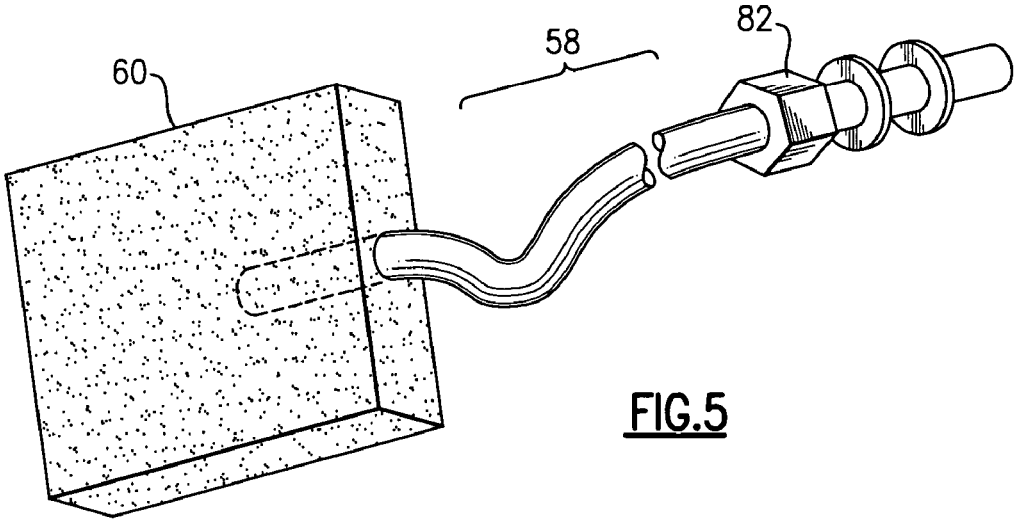
FIG. 5 shows the distal end of the vacuum hose and the foam block or porous pad of this embodiment.

A main vacuum line or hose 54 is formed of a flexible vacuum tubing, typically about one centimeter diameter, and this extends to a penetration or hole 56 in the side wall 30 of the barrel. Inside the barrel, a distal portion 58 of the vacuum hose ends at a block or pad 60 of a porous material. This may favorably be an open-cell plastic foam, but may be a fibrous material or other suitable porous material. The role of the pad 60 is to diffuse the flow of air into the opening at the end of the vacuum hose, and to maintain some space between the liner bag and the barrel bottom, so that the vacuum is distributed over a fairly wide region and the bag does not collapse directly onto the hose. The pad also serves as a filter to keep stray dust or other particulates from entering the hose and contaminating the vacuum pump 52. The shape of the pad is not critical, and while a the pad has a generally rectangular block shape here, in some cases the pad may be round. The pad is preferably formed of a soft material that evenly distributes the vacuum to resist puncture or tears of the liner. In this embodiment, as shown in FIG. 5, the end of the distal portion 58 of the end of the vacuum hose is embedded within the pad 60, entering at one side wall of the block. Alternatively, the vacuum, hose may lie directly on the barrel bottom and the pad may be placed on top of the hose, and between it and the lower end of the liner.

A control switch 62, here positioned on the dolly 38, has a main cord that can be plugged into a main source of AC line current (110V or 220V, as appropriate for the unit), and switched lines that feed the blower motor for the main system air pump 44 and the hold-down vacuum pump 52, respectively. The control switch ensures that the power is applied to the vacuum hold-down whenever power is applied to the main system air pump 44, so that the system vacuum is not applied unless there is also vacuum in the hold-down feature, ensuring that the liner 32 is not drawn up out of the barrel. Favorably, the control switch can include a time delay so that there is vacuum applied to the hold-down feature for a brief interval prior to application of power to the main system air pump.

In the illustrated embodiment, the vacuum pump 52 has a pair of inlets, and a wye connection is formed by a pair of short lengths 64, 64 of flexible vacuum tubing that meet at a tee connector 66. Another length of flexible tubing 68 extends from the stem of the tee connector to an in-line air filter 70, which is installed to protect the vacuum pump 52 from process dust D that may enter the bag hold-down. The main vacuum hose 54 then extends from the filter 70 to the penetration 56 on the barrel.

Figure 3:
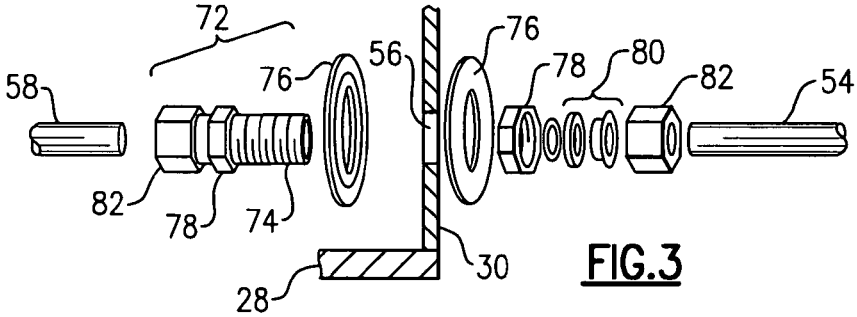
FIG. 3 shows a bulkhead fitting employed in this embodiment.

A bulkhead fitting 72 is fitted into the penetration 56 to connect the main portion of the vacuum hose 54 with the distal portion 58 which is inside the barrel 26. The construction of this is illustrated in FIG. 3. The bulkhead fitting employs a threaded tube or nipple 74 that fits through the penetration 56. Washers 76, 76 with incorporated silicone rubber seals are placed over the nipple against the outside and inside of the barrel side wall 30, and hex nuts 78 secure the nipple 74 in place and compress the washers and seals against the barrel over the penetration 56 to prevent air leakage into the barrel at that point. There are various seals 80 provided for the outside vacuum hose 54 and the inside or distal portion of the vacuum hose 58, and end nuts 82 that secure the hoses or tubing in place onto the nipple. At installation, care should be taken to drill the penetration hole 56 at a sufficient height above the base or bottom 30 of the barrel so as to accommodate the washers 76, 76 and other hardware.

Figure 4:
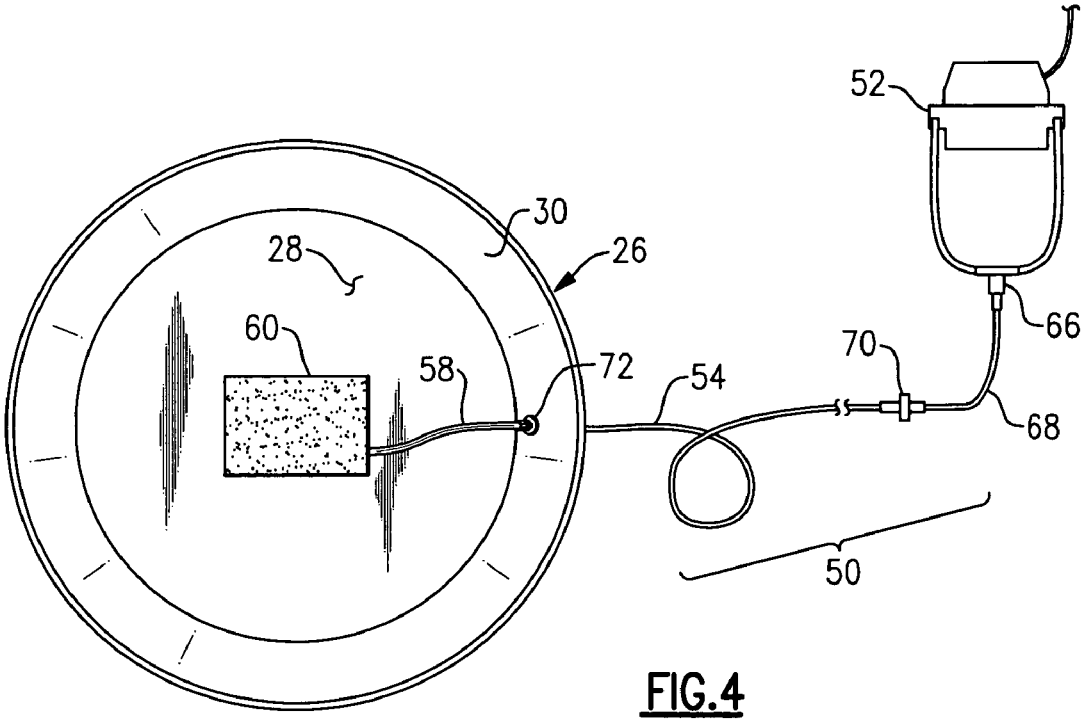
FIG. 4 top view of this embodiment, without the liner and with the cyclonic head removed.

The pad 30 can be situated at the center of the barrel bottom 28, as shown in FIG. 4.

When the hold-down unit is installed on the drum or barrel 26, the drum should be thoroughly vacuumed out before installation. A ¾-inch hole can be drilled at the side of the drum to serve as the pass through or penetration. This should be high enough above the bottom to provide clearance for the washers 76. Then the bulkhead fitting 72 is installed. The interior assembly, including open cell foam pad 60 and distal tubing 58, with the connecting hardware for the bulkhead fitting 72, as shown in FIG. 5, are attached to the bulkhead fitting 72 on he inside of the drum. Before doing this step, the drum is thoroughly cleaned out of dust. Then with the foam pad 60 in place (See FIG. 4), the barrel is ready to accept a bag liner. The liner is placed into the barrel, and the closure plate 24, with the cyclone separator 16, us secured on the top of the barrel and the liner. Then the dust collection station 14 is ready to accept the process dust from the dust source 10. The hold down system should be run at all times when the dust collection station is in use to overcome the negative pressure created by the cyclone separator 16.

The bag hold down system of this invention can be applied outside the disclosed dust collection application, and can be used anywhere that there is a bulk product being deposited in a liner inside a barrel or other container. That is, the invention can be applied wherever bulk solids are collected and deposited inside a plastic bag or similar liner. These applications may include, for example, material conveying, pharmaceuticals, dairy products, or other foodstuffs.

The dust collection system has a low power/low energy requirement, and the system can be powered entirely from a convenient 110V or 220V single phase supply. The operator does not need to interrupt the sanding, grinding, or finishing process for unclogging or emptying bags or filters, or for removing waste bags from the tool or machine. Waste material is carried continuously from the tool or other source to a sufficiently large off-worksite container. There is improved fire safety as any friction-induced flame or sparks will not reach the storage location for the combustible waste material, for the waste collection barrel is far downstream of grinding or sanding operation, and is at a location far from the operator. The filter service interval is also very long, and pressure loss through the filter cartridges is also very low. The filtration of air and separation of dust vastly improves the industrial hygiene for the operators. The dust collection station can receive process dust from several dust sources at the same time.

While the invention has been described hereinabove with reference to a few preferred embodiments, it should be apparent that the invention is not limited to such embodiments. Rather, many variations would be apparent to persons of skill in the art without departing from the scope and spirit of this invention, as defined in the appended Claims.

I claim:

1. In a dust collection system for collecting production dust from a source that generates such dust in a production operation, and storing said dust in a film collection bag liner within a dust collection barrel at a collection station remote from said dust source; the dust source comprising means for exhausting the dust entrained in a stream of air; a conduit coupled between the dust source and the remote collection station conveys the stream of air and the dust entrained therein to the collection station; the collection station comprising a barrel having a side wall and a bottom and a flexible film bag liner therein into which the dust is collected, the liner being a barrier to dust and air to contain the dust and permit easy removal of the dust, wherein the bag liner is adapted to being lifted out for disposal of the collected dust; separator means mounted above said barrel for separating out the dust from said stream of air, such that the dust falls into said barrel while the stream of air continues and flows to a pump and filter arrangement that generates a negative pressure to induce the stream of air to flow, with the air being filtered and returned into the ambient as clean filtered air, such that a negative pressure exists within said separator means, and such that said negative pressure exists also within the bag liner; and a vacuum hold-down arrangement which maintains a negative pressure between the bag liner and the wall and bottom of the barrel, the hold-down arrangement including a vacuum source producing a negative pressure of a magnitude greater than the negative pressure within said separator means;

a vacuum hose extending from said vacuum source through a penetration in said barrel into an interior space of said barrel; and the improvement in which a porous pad, separate from said bag liner and formed of an open-textured material, is situated against a distal end of said vacuum hose within said barrel between said bag liner and said barrel, and serves to distribute air flow from the space between the bag liner and the barrel into the distal end of the hose.

2. A dust collection system according to claim 1 wherein said collection station includes a cyclone separator having an inlet port to which said conduit is connected, said barrel being positioned below a lower end of said cyclone separator for receiving the dust carried to the separator through said conduit, and said pump and filter arrangement includes a pump for drawing air through said cyclone separator to create a negative pressure in said cyclone and said barrel, and an air filter interposed between an outlet baffle of said cyclone separator and an air exhaust outlet.

3. A dust collection system according to claim 1 wherein said vacuum source includes a small-volume pump separate from said pump and filter arrangement, inducing a negative pressure between about one and three psig.

4. A dust collection system according to claim 3 wherein said vacuum hose includes an in-line filter situated between the penetration in said barrel and said vacuum source.

5. A dust collection system according to claim 1 wherein said vacuum hold-down arrangement further includes a bulkhead fitting sealably positioned within the penetration of said barrel, and with a proximal portion of said vacuum hose sealably fitted to said bulkhead fitting and extending towards said vacuum source and with a distal portion of said vacuum hose sealably fitted to said bulkhead fitting and extending into the interior of said barrel.

6. A dust collection system according to claim 5 wherein said bulkhead fitting includes a threaded tube passing through said barrel penetration; outer and inner seals disposed over said threaded tube and situated against outer and inner sides of the barrel side wall, respectively, threaded fastener means mounted onto an outer thread of said threaded tube for sealably holding the outer and inner seals against the side wall of said barrel; and first and second threaded fittings for sealably holding the proximal and distal portions of said vacuum hose to exterior and interior ends, respectively, of said threaded tube.

7. A dust collection system according to claim 5 wherein said penetration is situated on the side wall of said barrel adjacent the bottom.

8. A dust collection system according to claim 1 wherein said vacuum hose includes a flexible tubing of about one centimeter diameter.

9. A dust collection system according to claim 1 wherein said porous pad includes a member formed of an open-cell plastic foam.

10. A dust collection system according to claim 1 wherein said porous pad includes a block of open textured material that is about six inches across and about one inch in thickness, and having the distal end of said vacuum hose penetrating into the block.

11. A dust collection system according to claim 1 wherein said vacuum source is separate from said pump and filter arrangement, and further comprising a power switch for actuating switching on power to the vacuum source simultaneously with application of power to said pump and filter arrangement.

12. A dust collection system according to claim 1 wherein said vacuum source is separate from said pump and filter arrangement, and further comprising a power switch arrangement for actuating power to the vacuum source in advance of application of power to said pump and filter arrangement.

13. A vacuum bag hold-down arrangement for a bulk solids collection station, wherein the bulk solids collection station comprises a container having a base and a side wall rising from said base to an upper rim, and a plastic film liner bag disposed in said container with a closed end against the base and an open end extending over said rim so as to receive said bulk solids through said open end, the liner bag being a barrier to dust and air, and removably placed in the container such that the liner bag can be closed off and lifted out when full for removal and disposal of the collected bulk solids; and separator means located above said container for separating the bulk solids from a stream of air in which the bulk solids are entrained, such that the bulk solids fall into said liner within the container barrel while the stream of air continues and exits above said container, such that a negative pressure exists within said container; the hold-down arrangement comprising:

a vacuum producer creating a negative pressure;

a vacuum conduit extending from said vacuum producer through a penetration in said container and extending into the interior of said container in a space defined between said container and said liner bag; said conduit having an opening therein to admit air from the space between the liner bag and the container; and a porous pad of an open-textured material lying on the base of said container within the space defined between liner bag and the container and over the opening of the vacuum conduit, the porous pad being separate from said liner bag and separate from the base of said container, separating the bag liner from the vacuum conduit.

14. A vacuum bag hold-down arrangement according to claim 13, comprising sealing means surrounding said penetration in said container for preventing air leakage into said space between the container and the bag liner.

15. A vacuum bag hold-down arrangement according to claim 13, comprising an in-line air filter situated in line in said vacuum conduit outside said container and in advance of said vacuum producer.

16. A vacuum bag hold-down arrangement according to claim 13, wherein said porous pad includes an open cell foam pad situated at the base of said container.

17. A vacuum bag hold-down arrangement according to claim 13, wherein said vacuum producer includes a vacuum pump providing negative pressure of about one to three psi at a low volume airflow.

18. A vacuum bag hold-down arrangement according to claim 13, wherein said porous pad includes an open texture fibrous material situated at the base of said container.

19. A dust collection system according to claim 1 wherein said porous pad includes a member formed of an open texture fibrous material.

20. A dust collection system according to claim 1 wherein said porous pad is round and occupies substantially the entire bottom of said barrel.

21. A dust collection system according to claim 1 wherein said porous pad is made of a soft porous material that evenly distributes the vacuum to the space between the barrel and the liner.

* * * * *